US005135714A

United States Patent [19]

Wang

[11] Patent Number: 5,135,714

[45] Date of Patent: Aug. 4, 1992

[54] PROCESS FOR STERILIZING A WEB OF PACKAGING MATERIAL

[75] Inventor: James J. Wang, Santa Clara, Calif.

[73] Assignee: FMC Corporation, Philadelphia, Pa.

[21] Appl. No.: 490,209

[22] Filed: Mar. 8, 1990

[51] Int. Cl.[5] ..... A61L 2/14

[52] U.S. Cl. ..... 422/23; 422/29; 422/32; 422/34; 422/906; 250/424; 250/455.11; 250/492.1; 204/164; 204/295

[58] Field of Search ..... 422/32, 34, 24, 29, 422/23, 37, 906, 907; 250/424, 455.1, 492.1; 204/164, 295

[56] References Cited

U.S. PATENT DOCUMENTS

| | | | |
|---|---|---|---|
| 1,881,310 | 10/1932 | Coatsworth . | |
| 2,070,307 | 2/1937 | Nicholls | 204/31 |
| 3,877,152 | 4/1975 | Gorman | 34/43 |
| 3,994,686 | 11/1976 | Rauser et al. | 21/102 R |
| 4,012,321 | 3/1977 | Koubek | 210/63 R |
| 4,225,556 | 9/1980 | Lothman et al. | 422/28 |
| 4,289,728 | 9/1981 | Peel et al. | 422/24 |
| 4,366,125 | 12/1982 | Kodera et al. | 422/295 |
| 4,401,708 | 8/1983 | Paul | 427/45.1 |
| 4,780,287 | 10/1988 | Zeff et al. | 422/186.3 |
| 4,792,407 | 12/1988 | Zeff et al. | 210/748 |
| 4,849,114 | 7/1989 | Zeff et al. | 210/747 |

OTHER PUBLICATIONS

Wallace et al., "The Combination of Ozone/Hydrogen Peroxide and Ozone/UV Radiation for the Reduction of Trihalomethane Formation Potential in Surface Water," *Ozone Science & Eng.*, vol. 10, 103-112 (1988).

Peyton et al., "Destruction of Pollutants in Water with Ozone in Combination with Ultraviolet Radiation. 1. General Priniples and Oxidation of Tetrachloroethylene," *Env. Sci. Technol.*, 16, 448-453 (1982).

Berglind et al., "Removal of Organic Matter by UV and Hydrogen Peroxide," Source Unknown, pp. 510-523.

Aieta et al., "Advanced Oxidation Processes for Treating Groundwater Contaminated with TCE and PCE: Pilot-Scale Evaluations," *Journal AWWA, May, 1988, pp. 64-72.*

Kirk-Othmer, "Encyclopedia of Chemical Technology", Third Edition, vol. 16, pp. 700-701, John Wiley & Sons (1981).

*Primary Examiner*—Robert J. Warden
*Assistant Examiner*—Lyle A. Alexander
*Attorney, Agent, or Firm*—R. E. Elden; A. J. Moore

[57] ABSTRACT

A process is provided for sterlizing a web of packaging materials which is to be formed into containers for aseptic packaging. The process comprises contacting the web with aqueous solution of ozone and hydrogen peroxide and subsequently irradiating the surface with ultra-violet radiation.

17 Claims, 3 Drawing Sheets

CONTOUR PLOT OF REDUCTION OF VIABLE SPORE COUNT ($H_2O_2$ = 0.5 mg/cm$^2$)

CONTOUR PLOT OF REDUCTION VIABLE SPORE COUNT ($H_2O_2$ = 0.5 mg/cm$^2$)

CONTOUR PLOT OF REDUCTION OF VIABLE SPORE COUNT ($H_2O_2$ = 1.5 mg/cm$^2$

PROCESS FOR STERILIZING A WEB OF PACKAGING MATERIAL

This invention is a process to sterilize materials, particularly packaging materials in the form of long sheets or rolls which are subsequently shaped into containers and filled under aseptic conditions.

Hydrogen peroxide sterilization at room temperature has been used in some instances, but at room temperature the sterilizing or germicidal power is weak and is inadequate for full sterilization. On the other hand, heated $H_2O_2$, which has a powerful sterilization effect, has been proposed. When using heated $H_2O_2$vapor tends to leak out of the apparatus, which is hazardous to the operator. Furthermore, a large-capacity drying step is required. In addition, there is also the possibility of some $H_2O_2$remaining because of inadequate drying.

On the other hand, sterilization of packaging materials by irradiation with an ultra-violet light source (UV lamp) is a dry-type sterilization, in which a drying step is unnecessary. It is a simple and convenient method of sterilization. However, even with the use of powerful UV lamps, a long irradiation time is required for thorough sterilization, and this long irradiation time may damage the packaging material by lowering its heat-seal strength, and by discoloring it.

U.S. Pat. No. 4,289,728 and U.S. Pat. No. 4,366,125 teach the combined use of the sterilization effects of $H_2O_2$and a UV lamp. Although spores of many microorganisms are destroyed at ambient temperatures, it is necessary, particularly when treating resistant microorganisms, to maintain the solution at an elevated temperature either during irradiation or subsequent thereto. In general, such temperatures do not exceed 100° C. The temperature, at least when treating resistant organisms, is usually however, at least 85° C.

Ozone, $O_3$, an allotropic form of oxygen, has been used for more than 60 years for drinking water treatment in Europe, mainly because of superior taste control, odor control and color removal. In the late 1960's and 1970's, ozone was considered as a disinfection alternative to chlorine in the United States. The potent germicidal properties of ozone at one time were attributed to its high oxidation potential. Research studies indicate that disinfection by ozone is a result of bacteria wall disintegration and this mechanism of disinfection by ozone is different from that of chlorine. Owing to the unstable nature of ozone molecules, it is very difficult to control the disinfection process. Moreover, it takes a fairly long contact time to inactivate microorganisms.

Ozone can be generated from oxygen either in an electrostatic field, or by ultra-violet radiation having a wavelength less than 200 nm. On the other hand, it is known that UV with a wavelength between 200 and 300 nm will decompose ozone. It is generally preferred to generate ozone in an electrostatic field rather than by UV because much higher concentrations of ozone can be prepared.

Two factors are important when sterilizing a web of packaging material: 1) substantially no residual chemicals should remain on the surface of the web, and 2) each step of the sterilization process should be completed within a very short period of time. No step should require more than a minute; desirably, each step should require less than 20 seconds and preferably 1 to 10 seconds.

The present invention is a process for sterilizing a web of packaging material comprising the steps of:

a) directing a stream of oxygen-containing gas through an ozonizer to provide an ozone-containing gas, b) incorporating ozone from said ozone-containing gas and hydrogen peroxide into an aqueous solution, c) contacting said web of packaging material with sufficient aqueous solution from step (b) to provide thereon at least 0.1 micrograms ozone per square centimeter and at least 0.1 milligrams hydrogen peroxide per square centimeter, and d) irradiating said web from step (c) for 1 to 60 seconds with 10 to 200 milliwatt-seconds of ultra-violet radiation per square centimeter, said ultra-violet radiation having a wavelength of between 200 and 300 nanometers, thereby providing a web surface with less than 1 microgram of hydrogen peroxide per square centimeter, and with a substantially reduced bacterial spore count.

The combination of ozone and UV is taught by U.S. Pat. No. 2,070,307. However, it was found that the combination required 1.5 minutes of exposure to 2.8% ozone in the presence of 13.8 mW UV/cm$^2$ to substantially reduce the bacterial spore count by 99.99%.

Processes employing combinations of UV, ozone and hydrogen peroxide to the oxidation of chemicals in aqueous streams yield contradictory results, probably because of the extreme differences in conditions. For example, U.S. Pat. No. 4,792,407 teaches that the combination of UV, ozone and hydrogen peroxide is at best better by a factor of 10 than the combination of any two, but only with exposure times of about 30 minutes while using five-fold excesses of both ozone and hydrogen peroxide. However, Wallace et al., "The Combination of Ozone/Hydrogen Peroxide and Ozone/UV Radiation for Reduction of Trihalomethane Formation Potential in Surface Water", *Ozone Science and Engineering*, 10, pages 103–112, discloses the combination of UV, ozone and hydrogen peroxide is no more effective after one hour than the combination of either ozone with hydrogen peroxide or ozone with UV.

These disparate conclusions are probably not only the result of different experimental conditions applied to the oxidation of different chemical compounds, but also can be attributed to the fact that ozone, hydrogen peroxide and UV each affect the efficacy of the other. For example, hydrogen peroxide is essentially opaque to UV, thereby preventing a UV-ozone interaction, while UV decomposes both ozone and hydrogen peroxide preventing their interaction.

Although an ozone-containing gas can be prepared by any convenient means, it is preferred that the ozonizer be an electric discharge ozonizer for economic reasons. Generally, any dry gas containing molecular oxygen, such as air, oxygen or oxygen-containing streams of an inert gas may be used. Gas containing water vapor or other hydrogen-containing compounds is not desirable because of side reactions of the hydrogen with ozone.

The ozone-containing gas and hydrogen peroxide are incorporated into an aqueous solution by any convenient means, and the aqueous solution is contacted with a web of packaging material in sufficient amount to provide at least 0.1 and desirably from 0.1 to 1 micrograms ozone per square centimeter of the web of packaging material and at least 0.1 and desirably from 0.1 to 1 milligrams hydrogen peroxide per square centimeter of the web of the packaging material; more desirably at least 0.3 micrograms of ozone and at least 0.2 milligrams of hydrogen peroxide per square centimeter; preferably about 0.3 to 0.6 micrograms of ozone and about 0.2 to 0.5 milligrams of hydrogen peroxide per square centimeter of the web of packaging material.

It is particularly convenient to absorb ozone from an ozone-containing gas into a solution of water by sparging the gas through water or by injecting and condensing water vapor in ozone-containing gas to provide an ozonized water containing from about 5 to 20 mg/l ozone.

At 101 kPa (1 atmosphere) a gas containing 2% ozone will be in equilibrium with an aqueous solution containing 12 mg/l ozone at 3° C., or about 5 mg/l ozone at 30° C. Concentrations of about 5 mg/l to 20 mg/l ozone in an aqueous solution are feasible for ozone manufactured by the silent discharge process. Concentrations of about 10 mg/l to 20 mg/l ozone are preferred.

Hydrogen peroxide can be incorporated into an aqueous solution simply by adding a commercial solution of hydrogen peroxide. Although it is desirable to add hydrogen peroxide to an aqueous solution of ozone, the reverse procedure may be employed. More desirably, sufficient commercial hydrogen peroxide is added to an aqueous solution of ozone to provide a hydrogen peroxide of from 100 times to 10,000 times the ozone concentration. Preferably sufficient hydrogen peroxide should be incorporated to provide 0.2 to 0.6 g/l $H_2O_2$in the aqueous solution.

The aqueous solution of hydrogen peroxide and ozone are distributed uniformly over the surface of the web of packaging material to provide at least 0.1 microgram of ozone and 0.1 milligram of hydrogen peroxide contacting each square centimeter of web. Desirably sufficient ozone is applied to provide about 0.1 to 1 microgram of ozone and 0.1 to 1 milligram of hydrogen peroxide per square centimeter of the web.

The aqueous solution can be applied or contacted to the web by any convenient method, such as by contacting with fine spray droplets optionally in the presence of a surfactant, by contacting the web with a roller moistened by the aqueous solution, by spreading a liquid layer of aqueous solution by a doctor blade or by immersing the web in the aqueous solution.

After contacting the surface of the web with the aqueous solution of ozone and hydrogen peroxide the surface is irradiated to provide from 10 to 200, and desirably from 60 to 150, milliwatt-seconds of ultra-violet radiation having a wavelength of between 200 and 300 nanometers for a period of 0.1 to 60 seconds; preferably for 5 to 20 seconds.

Other than traces of moisture there is substantially no chemical residue remaining on the web of packaging material. That is, ozone is not detectable and less than 1 microgram of hydrogen peroxide is usually found per square centimeter of the web.

Much of the water in the aqueous solution will have evaporated during the processing. However, residual moisture optionally can be removed from the web by heat or infra-red radiation. The bacteria spore count can be reduced by at least 99.999%.

The best mode of practicing the invention will be obvious to one skilled in the art from the following nonlimiting examples.

The following procedure was employed in the examples unless otherwise specified.

The experiments involved subjecting spore (*B.pumilus* ATCC 27142), known to be the most resistant to irradiation, loaded onto a plastic strip (polypropylene based) as follows:

(1) Load plastic strip ($1.5\times4$ cm$^2$) with spores ($1.7\times10^7$).

(2) Dry the spores in an electrical dessicator overnight.

(3) Contact the test material by spraying with 0.22 ml of an aqueous test solution of ozone and hydrogen peroxide.

(4) Immediately following step (3) the material was exposed for 10 to 30 seconds to UV irradiation at intensity of 13.8 mW/cm$^2$. The UV lamp was a UV-C (short wave lamp) made by American Ultraviolet Company.

(5) Collect all of the spore survivors in 5 ml of saline solution containing 0.1% Tween −80+, an appropriate amount of sterile glass beads and peptone to decompose any chemical residue.

(6) Determine survivor count by means of standard pour plate technique.

(7) The effectiveness of the treatment was determined by statistical analysis of a 3 variable, 3 level experiment design.

Test strips were tested separately to determine any chemical residues.

EXAMPLE

The experiment designed was as follows:

| | Independent Variables | | | |
|---|---|---|---|---|
| | −1 | 0 | +1 | |
| UV | 10.0 | 20.0 | 30.0 | seconds |
| $H_2O_2$ | 0.50 | 1.00 | 1.50 | % in solution |
| Ozone | 2.0 | 2.4 | 2.8 | % wt. in vapor phase |

The dependent variable was reported as the "log" reduction of the initial count of bacteria spores ($1.7\times10^7$). That is:

−5 log reduction in spores =killing 99.999% of the initial number of spores

−4 log reduction in spores =killing 99.99% of the initial number of spores

−1 log reduction in spores =killing 90% of the initial number of spores.

The data are presented as Table I.

The statistical analysis of the data shows

1) UV in general performs better than ozone by a factor of 10 (1 log).

2) Ozone/UV and hydrogen peroxide/UV systems perform better than ozone by a factor of 100; better than UV by a factor of 10.

Data further revealed that it took 1 ½ minutes of contact time to accomplish a 4 log reduction in bacterial spores using a system comprised of ozone solution (2.8% wt) and UV irradiation (13.8 mW/cm$^2$). A thousand-fold reduction was observed by systems consisting of aqueous ozone plus UV irradiation.

In order for a disinfection system to be incorporated into modern high speed aseptic packaging machinery, improvement in the system's effectiveness as well as its killing rate becomes the first priority. This was attained as shown by our discovery of a method involving the use of ozone, $H_2O_2$and UV that reduces bacterial spores by $10^{-6}$with only a 10 second contact time. No $O_3$. residual was found on the packaging material and only minute quantities of $H_2O_2$(<0.04%) were detected at the end of the sterilization process.

BRIEF DESCRIPTION OF THE DRAWINGS

Contour plots of the results of the statistical analysis are presented as FIGS. 1, 2 and 3. The contours are the log reduction based on initial spore numbers minus survivors after the treatment.

Figure 1:
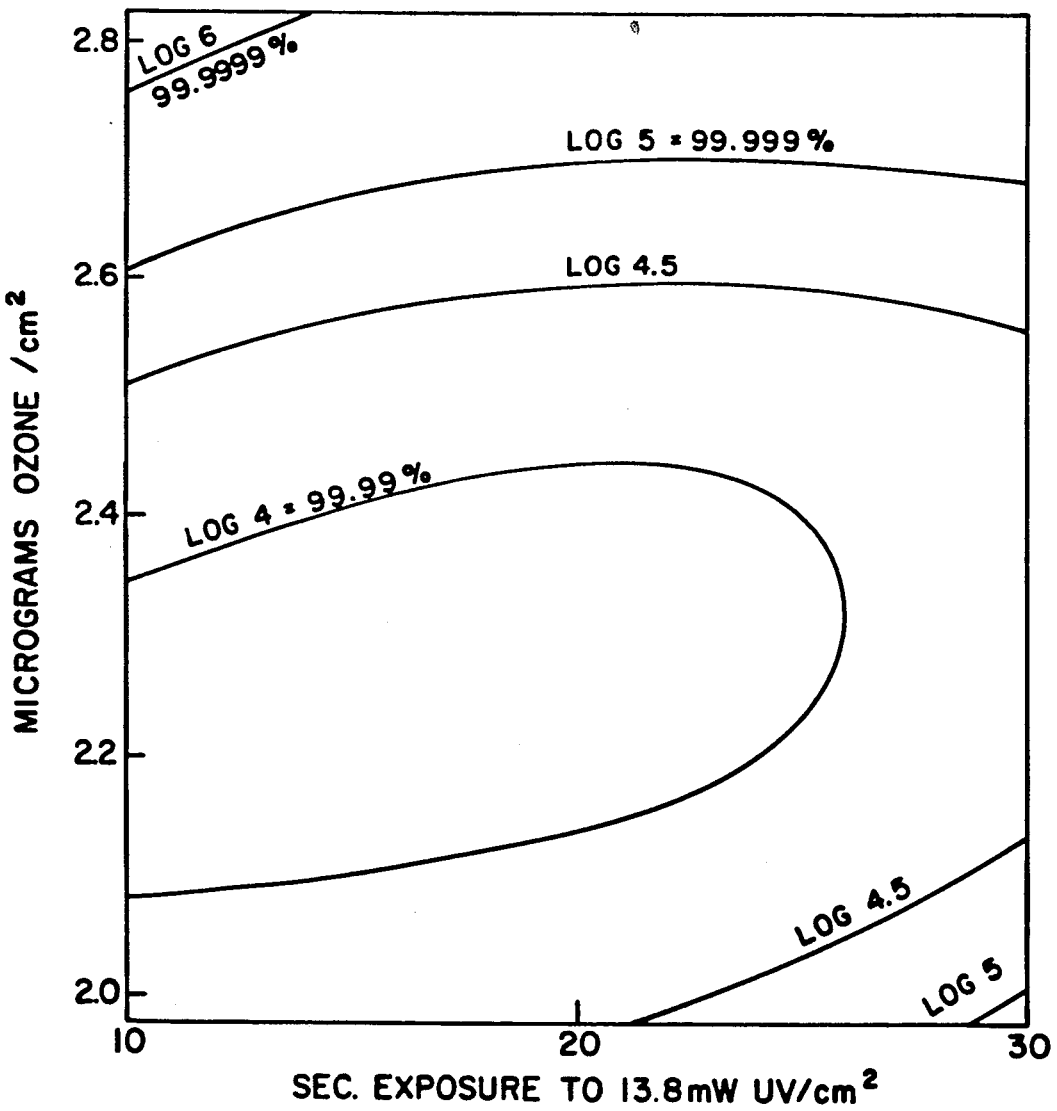
FIG. 1 shows the contours when $H_2O_2$is held constant at 0.5%, and ozone varies from 2.0 to 2.8% wt. and UV exposure varies from 10 to 30 seconds.
Figure 2:
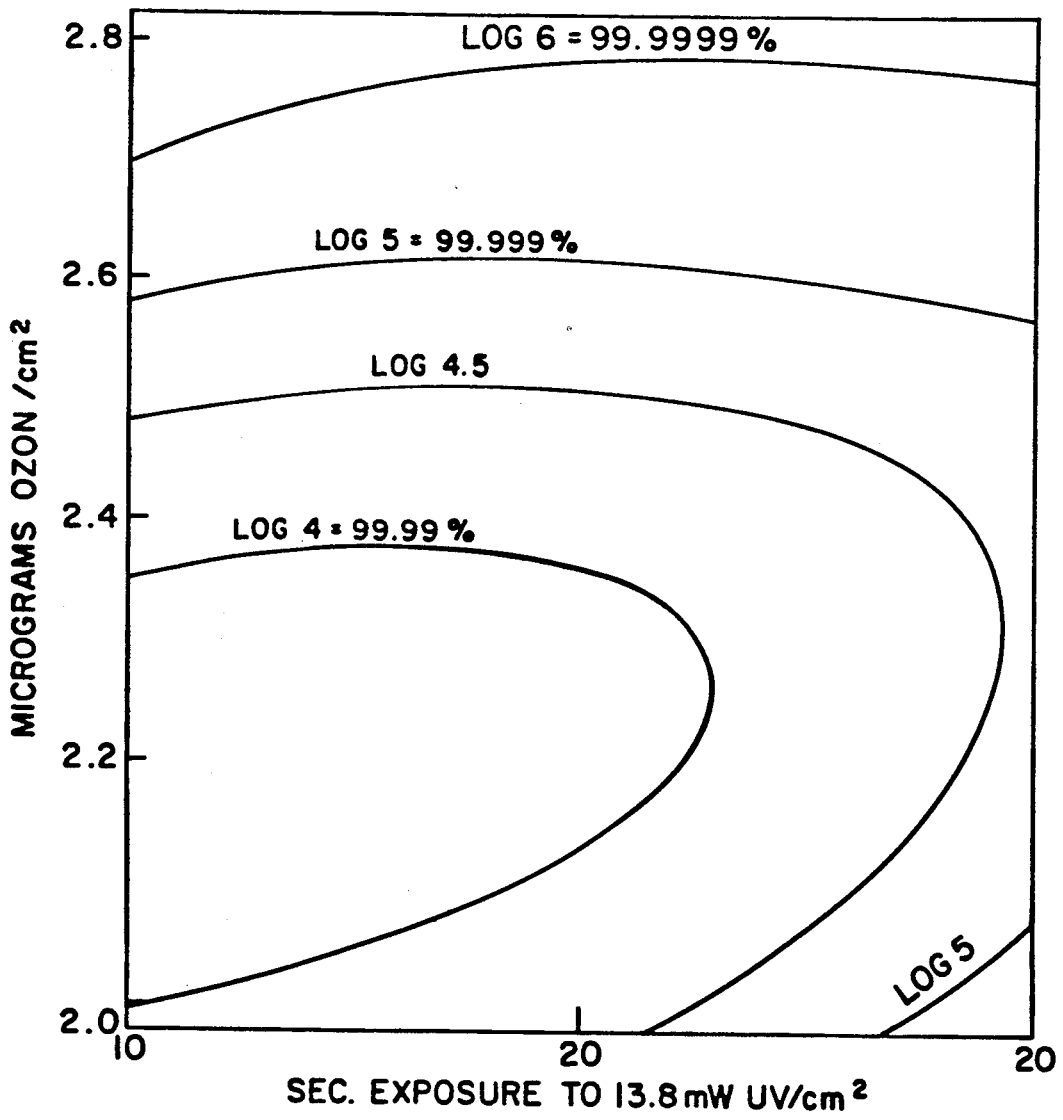
FIG. 2 shows the contours when $H_2O_2$is held constant at 1.0%.
Figure 3:
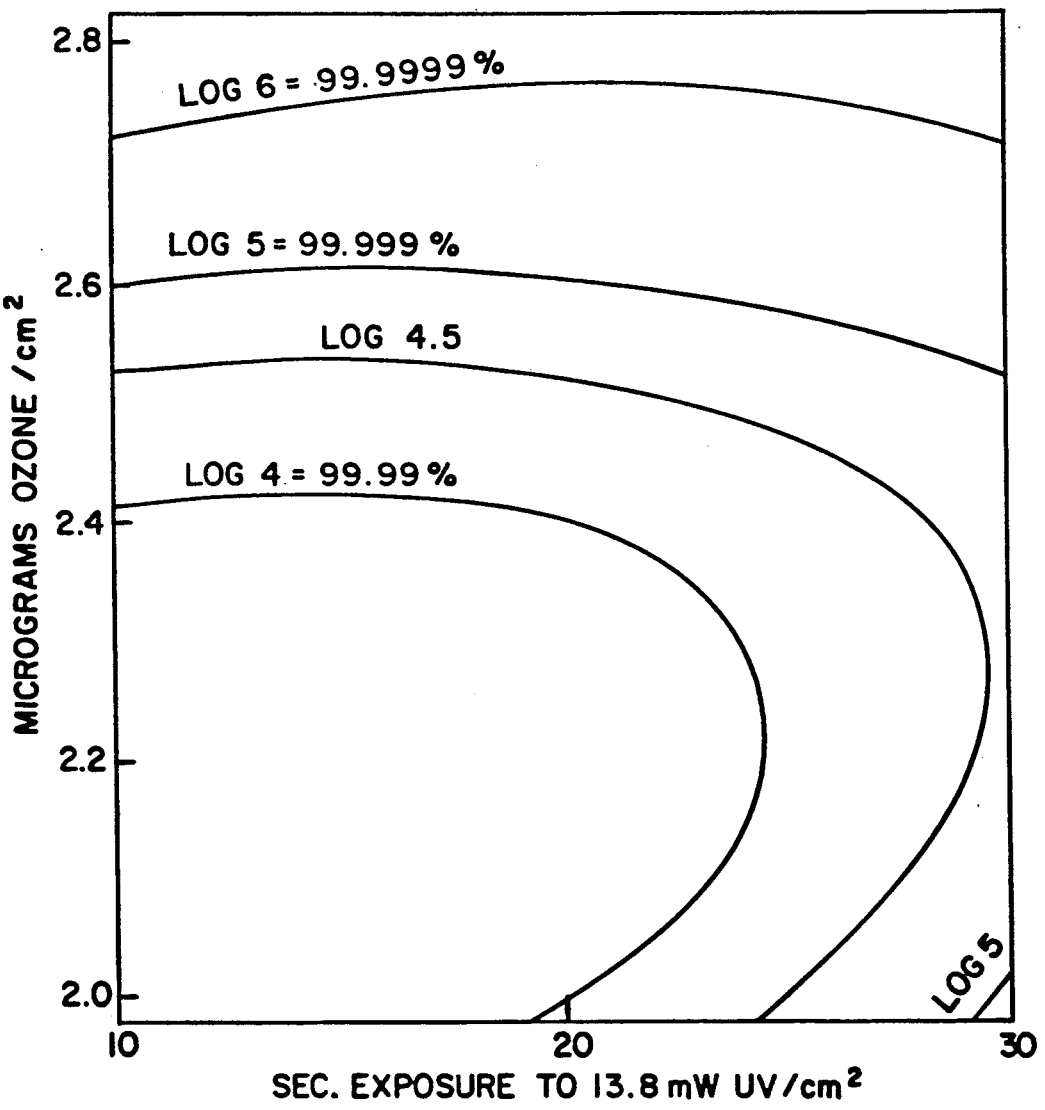
FIG. 3 shows the contours when $H_2O_2$is held constant at 1.5%.

The figures show that the combined treatment of ozone, hydrogen peroxide and ultra-violet is not a simple additive combination. Instead, there is an unexpected and unpredictable interaction between the ozone, hydrogen peroxide and ultra-violet irradiation.

TABLE I

| UV sec | $H_2O_2$ mc/cm$^2$ | $O_3$ $\mu$g/cm$^2$ | Response log spore reduction |
|---|---|---|---|
| 30 | 0.50 | 2.40 | 4.51 |
| 20 | 1.00 | 2.40 | 4.11 |
| 30 | 1.00 | 2.40 | 4.14 |
| 20 | 1.50 | 2.00 | 4.11 |
| 10 | 1.00 | 2.80 | 6.29 |
| 20 | 0.50 | 2.80 | 5.58 |
| 10 | 0.50 | 2.40 | 4.47 |
| 30 | 1.50 | 2.40 | 4.20 |
| 30 | 1.00 | 2.30 | 5.91 |
| 10 | 1.50 | 2.40 | 3.41 |
| 20 | 1.50 | 2.30 | 7.19 |
| 10 | 1.00 | 2.00 | 4.17 |
| 10 | 1.00 | 2.00 | 5.58 |
| 20 | 1.00 | 2.40 | 4.13 |
| 20 | 0.50 | 2.00 | 3.51 |

I claim:

1. A process for sterilizing a web of packaging material comprising the steps of:

a) directing a stream of oxygen-containing gas through an ozonizer to provide an ozone-containing gas, b) incorporating ozone from said ozone-containing gas and hydrogen peroxide into an aqueous solution, c) contacting said web of packaging material with sufficient aqueous solution from step (b) to provide thereon at least 0.1 micrograms ozone per square centimeter and at least 0.1 milligrams hydrogen peroxide per square centimeter, and d) irradiating said web from step (c) for 1 to 60 seconds with 10 to 200 milliwatt-seconds of ultra-violet radiation per square centimeter, said ultra-violet radiation having a wavelength of between 200 and 300 nanometers, thereby providing a web surface with less than 1 microgram of hydrogen peroxide per square centimeter, and with a substantially reduced bacterial spore count.

2. The process of claim 1 wherein the web is contacted with sufficient aqueous solution to provide at least 0.3 micrograms of ozone and at least 0.5 milligrams of hydrogen peroxide per square centimeter thereby reducing the bacterial spore count by 99.999%.

3. The process of claim 1 wherein sufficient ozone is incorporated into the aqueous solution to provide from 5 to 20 mg/l ozone therein.

4. The process of claim 2 wherein sufficient ozone is incorporated into the aqueous solution to provide from 5 to 20 mg/l ozone therein.

5. The process of claim 1 wherein sufficient hydrogen peroxide is incorporated into the aqueous solution to provide 0.2 to 0.6 g $H_2O_2$/l.

6. The process of claim 2 wherein sufficient hydrogen peroxide is incorporated into the aqueous solution to provide 0.2 to 0.6 g $H_2O_2$/l.

7. The process of claim 3 wherein sufficient hydrogen peroxide is incorporated into the aqueous solution to provide 0.2 to 0.6 g $H_2O_2$/l.

8. The process of claim 4 wherein sufficient hydrogen peroxide is incorporated into the aqueous solution to provide 0.2 to 0.6 g $H_2O_2$/l.

9. The process of claim 1 wherein the surface of the web of packaging material is irradiated with from 60 to 150 milliwatt seconds of ultra-violet radiation for a period of 5 to 20 seconds.

10. The process of claim 2 wherein the surface of the web of packaging material is irradiated with at least 150 milliwatt seconds of ultra-violet radiation for a period of 5 to 20 seconds.

11. The process of claim 3 wherein the surface of the web of packaging material is irradiated with at least 150 milliwatt seconds of ultra-violet radiation for a period of 5 to 20 seconds.

12. The process of claim 4 wherein the surface of the web of packaging material is irradiated with at least 150 milliwatt seconds of ultra-violet radiation for a period of 5 to 20 seconds.

13. The process of claim 5 wherein the surface of the web of packaging material is irradiated with at least 150 milliwatt seconds of ultra-violet radiation for a period of 5 to 20 seconds.

14. The process of claim 6 wherein the surface of the web of packaging material is irradiated with at least 150 milliwatt of ultra-violet radiation for a period of 5 to 20 seconds.

15. The process of claim 7 wherein the surface of the web of packaging material is irradiated with at least 150 milliwatt seconds of ultra-violet radiation for a period of 5 to 20 seconds.

16. The process of claim 8 wherein the surface of the web of packaging material is irradiated with at least 150 milliwatt seconds of ultra-violet radiation for a period of 5 to 20 seconds.

17. A process for sterilizing a web of packaging material comprising the steps of:

a) directing a stream of oxygen-containing gas through an ozonizer to provide an ozone-containing gas, b) incorporating ozone from said ozone-containing gas and hydrogen peroxide into an aqueous solution, c) contacting said web of packaging material with sufficient aqueous solution from step (b) to provide thereon from 0.1 to 1 micrograms ozone per square centimeter and from 0.1 to 1 milligrams hydrogen peroxide per square centimeter, and d) irradiating said web from step (c) for 1 to 60 seconds with 10 to 200 milliwatt-seconds of ultra-violet radiation per square centimeter, said ultra-violet radiation having a wavelength of between 200 and 300 nanometers, thereby providing a web surface with less than 1 microgram of hydrogen peroxide per square centimeter, and with a bacteria spore count reduced by at least about 99.99%.

* * * * *